US012420992B2

(12) United States Patent
Darby et al.

(10) Patent No.: US 12,420,992 B2
(45) Date of Patent: Sep. 23, 2025

(54) DISPENSING SYSTEM

(71) Applicant: Liqui-Box Corporation, Richmond, VA (US)

(72) Inventors: Ian Darby, Leicestershire (GB); Paul N. Georgelos, Naperville, IL (US); Matthew Ruschmeier, Glencoe, MN (US)

(73) Assignee: Liqui-Box Corporation, Richmond, VA (US)

( * ) Notice: Subject to any disclaimer, the term of this patent is extended or adjusted under 35 U.S.C. 154(b) by 222 days.

(21) Appl. No.: 18/143,455

(22) Filed: May 4, 2023

(65) Prior Publication Data

US 2023/0356892 A1 Nov. 9, 2023

Related U.S. Application Data

(60) Provisional application No. 63/338,619, filed on May 5, 2022.

(51) Int. Cl.
*B65D 47/06* (2006.01)
*B65D 41/02* (2006.01)

(52) U.S. Cl.
CPC ..... *B65D 47/06* (2013.01); *B65D 41/02* (2013.01)

(58) Field of Classification Search
CPC ..... B65D 47/06; B65D 41/02
USPC ..... 222/490
See application file for complete search history.

(56) References Cited

U.S. PATENT DOCUMENTS 7,980,424 B2 7/2011 Johnson
8,397,956 B2 * 3/2013 Olechowski ..... B65D 47/2031 222/490
8,413,857 B2 4/2013 Johnson
8,448,820 B2 5/2013 Johnson
9,592,944 B2 3/2017 Johnson
9,862,531 B2 1/2018 Johnson
10,227,167 B2 3/2019 Darby
10,618,703 B2 4/2020 Darby
10,981,190 B2 4/2021 Johnson
11,142,377 B2 10/2021 Johnson
D947,993 S 4/2022 Kieras
D958,939 S 7/2022 Kieras
11,572,224 B2 2/2023 Ruschmeier
(Continued)

FOREIGN PATENT DOCUMENTS

WO 2019/178018 A1 9/2019

OTHER PUBLICATIONS

PCT, Notification of Transmittal of the International Search Report and the Written Opinion of the International Searching Authority, or the Declaration, in Application No. PCT/US2023/021168 dated Jul. 31, 2023.

*Primary Examiner* — Paul R Durand
*Assistant Examiner* — Michael J. Melaragno
(74) *Attorney, Agent, or Firm* — Jon M. Isaacson

(57) ABSTRACT

A dispensing system for a liquid container including a cap configured to be mounted to a spout connected to a liquid container. The system includes a flexible valve positioned in the cap to be in contact with the liquid contents of the liquid container and a retaining ring connected to the cap to secure the flexible valve to the cap. The cap includes at least one channel defined by a projection configured to receive the tab of a connecting member and secure the connecting member to the cap by securing the tab in the channel under the projection.

18 Claims, 14 Drawing Sheets

(56) References Cited

U.S. PATENT DOCUMENTS

| | | | | |
|---|---|---|---|---|
| 11,628,984 | B2 | 4/2023 | Kieras | |
| 2010/0122991 | A1* | 5/2010 | Taguchi | B65D 47/061 222/83 |
| 2015/0028065 | A1 | 1/2015 | Arch et al. | |
| 2015/0336719 | A1 | 11/2015 | Bradley | |
| 2017/0113912 | A1* | 4/2017 | Johnson | F16L 37/40 |
| 2018/0079564 | A1 | 3/2018 | Darby et al. | |
| 2018/0297830 | A1 | 10/2018 | Kraenzle | |
| 2019/0092538 | A1 | 3/2019 | Johnson | |
| 2019/0281859 | A1 | 9/2019 | Bischel et al. | |
| 2020/0055723 | A1 | 2/2020 | Johnson | |
| 2020/0172302 | A1 | 6/2020 | Darby | |
| 2021/0001360 | A1 | 1/2021 | Johnson | |
| 2022/0135392 | A1 | 5/2022 | Kieras | |
| 2022/0297901 | A1* | 9/2022 | Kieras | B65D 77/40 |
| 2023/0356892 | A1* | 11/2023 | Darby | B67D 7/0294 |

* cited by examiner

DISPENSING SYSTEM

RELATED APPLICATIONS

This application claims priority to U.S. Provisional Application No. 63/338,619, which was filed on May 5, 2022. The complete subject matter and contents of U.S. Patent Application Ser. 63/338,619 are incorporated herein by reference in their entirety.

BACKGROUND

This present technology concerns a dispensing system for use with a container of liquid.

It is often required to provide a supply of a liquid such as milk to a drink dispensing machine such as a coffee machine, smoothie machine, or otherwise. Previously this has often been achieved by filling a part of the machine with, for instance, milk. In view of the relatively short shelf life of liquids such as milk, it is appropriate for such parts of the machine to be regularly emptied and thoroughly washed out. There is, however, a tendency for such parts to simply just be regularly topped up with milk. This can lead to unhygienic operating conditions, and, for instance, bacterial build up. Therefore, liquid can be provided in a bag-in-box system in which the liquid is in a flexible plastic bag located in a box. The bag is connected to a spout or fitment that extends out of the box. A dispensing mechanism from the machine can be connected to the fitment to dispense fluid from the bag.

SUMMARY

Certain embodiments of the present technology include a dispensing system for a liquid container. The system includes a cap configured to be mounted to a spout connected to a liquid container and that includes a bore configured to receive and engage a connecting member. The system includes a flexible valve positioned in the cap to be in contact with liquid contents of the liquid container. The system includes a retaining ring connected to the cap beneath the valve to secure the flexible valve to the cap. The cap includes at least one channel defined by a projection configured to receive a tab of the connecting member and secure the connecting member to the cap by securing the tab in the channel under the projection.

The dispensing may include the connecting member, and the connecting member may include an outlet and a projecting member with an inlet, wherein, when the connecting member is secured to the cap, the projecting member sealingly engages the bore and urges an opening in the valve to permit liquid in the container to pass into the inlet of the connecting member and subsequently out through the outlet. The opening in the valve may automatically close when the connecting member is detached from the cap. One of the bore and the connecting member may include a bead that is configured to form a seal between the bore and the connecting member when the connecting member is secured to the cap. The dispensing system may include a cover that covers at least a portion of the cap. The at least one channel may be located below a top surface of the cap. The bore and the valve may be integral and made of the same material and be secured between the retaining ring and an inner collar of the cap. The retaining ring and cap may be made of a thermoplastic material and the bore and the valve may be made of an elastomeric material. The valve may be a duckbill valve. The connecting member may include a valve positioned between the inlet and outlet such that the valve allows fluid to flow from the inlet to the outlet and prevents fluid from flowing from the outlet to the inlet. The valve may be secured below an inwardly extending flange of the cap. The retaining ring may be snapably connected to the cap to secure the valve to the cap. The bore is defined by an inner collar of the cap. The connecting member may include a seal and the cap may include an inwardly extending flange, wherein when the connecting member is secured to the cap, the seal engages the flange to create a seal therebetween.

Certain embodiments of the present technology include a dispensing system for a liquid container. The system includes a cap configured to be mounted to a spout connected to a liquid container. The system also includes a flexible valve positioned in the cap to be in contact with the liquid contents of the liquid container and a retaining ring mountable to the cap to secure the flexible valve to the cap. The cap includes at least one channel defined by a projection configured to receive the tab of a connecting member and secure the connecting member to the cap by securing the tab in the channel under the projection.

The system may further include a hollow connecting member including an outlet and a hollow projecting member which, when the connecting member is secured to the cap, engages the valve so as to urge an opening in the valve to permit liquid in the container to pass into the connecting member and subsequently out through the outlet. The opening in the valve may automatically close when the connecting member is detached from the cap. The cap of the system may include an inner collar that includes an inwardly extending bead that is configured to sealingly engage the connecting member when the connecting member is secured to the cap. The cap may be configured to be connected to a spout on the liquid container. The system may include a cover that covers at least a portion of the cap. The at least one channel of the system may be located below a top surface of the cap. The at least one channel of the system may be parallel to the top surface of the cap.

Certain embodiments of the present technology include a dispensing system for a liquid container. The system includes a cap configured to be mounted to a spout connected to a liquid container. The system includes a flexible valve positioned in the cap to be in contact with the liquid contents of the liquid container and a retaining ring mountable to the cap to secure the flexible valve to the cap. The system also includes a hollow connecting member with an outlet, wherein the connecting member is releasably securable to the cap. The connecting member includes a hollow projecting member which, when the connecting member is secured to the cap, engages the valve so as to urge an opening in the valve to permit liquid in the container to pass into the connecting member and subsequently out through the outlet.

The opening in the valve may automatically close when the connecting member is detached from the cap. The cap may include at least one channel defined by a projection, and the connecting member may include at least one tab, and the connecting member may be secured to the cap by rotating the connecting member with respect to the cap such that the tab is secured in the channel under the projection. When the tab is secured in the channel, the tab may be positioned in a cavity in the cap and may be located below a top surface of the cap. The at least one channel of the system may be parallel to the top surface of the cap. The connecting member may include a seal and the cap may include an inner collar that includes an inwardly extending flange, wherein when the connecting member is secured to the cap, the seal engages the flange to create a seal therebetween. The cap may include an inner collar that includes an inwardly extending bead and when the connecting member is secured to the cap, the bead may engage the projecting member to create a seal therebetween. The cap may be configured to be connected to a spout on the liquid container. The system may include a cover that covers at least a portion of the cap.

Certain embodiments of the present technology include a connecting member for use in dispensing fluid from a container. The connecting member includes an inlet member defining an inlet, an outlet member defining an outlet, and a flexible valve. The inlet member is configured to connect to a cap of a liquid container, the outlet member is configured to connect to a system supply line, and the flexible valve is positioned between the inlet and outlet such that the flexible valve allows fluid to flow from the inlet to the outlet and the flexible valve prevents fluid from flowing from the outlet to the inlet.

The flexible valve may be located within the inlet member of the connecting member. The connecting member may further include an outwardly extending connector flange, and the valve may be located below the connector flange. The connector flange may include at least one tab. The inlet member may include a main body and a valve retention piece, and the valve may further include a valve flange that is compressed between the main body and the valve retention piece. The valve retention piece may be connected to the main body using a snap fit connection. The valve retention piece may be releasably connected to the main body. The valve retention piece may have an outer diameter at an adjacent surface to the main body, the main body may have an outer diameter at an adjacent surface to the retention piece, and the valve retention piece outer diameter and the main body outer diameter may be generally the same. The valve retention piece may have an inner diameter at an adjacent surface to the valve, the flexible valve may have an inner diameter at an adjacent surface to the retention piece, and the valve retention piece inner diameter and the valve inner diameter may be generally the same. The valve may include a valve opening positioned within the connecting member main body. The connecting member inlet may be perpendicular to the outlet. The connecting member inlet and outlet may be aligned along the same axis and/or be parallel. The container cap may have an upper surface, and the valve may extend below the cap upper surface and may extend below the cap when the connecting member is connected to the cap. The connecting member may have a pointed tip for piercing an inner membrane of a single use style cap and/or the valve. The valve retention piece may have the pointed tip.

Certain embodiments of the present technology include a method for making a cap assembly for use with a spout connected to fluid packaging with a two shot injection moulding process. The method includes the steps of injecting a first molten resin into a first mold to make a cap having an inner collar and injecting a second molten resin into a second mold to make a valve and a bore within the cap, and connecting a retaining ring to the cap to secure the valve and bore between the inner collar and the retaining ring, wherein the retaining ring is located below the inner collar. The first resin may be a thermoplastic material and the second resin may be an elastomeric material. The valve and the bore may be formed as a single piece or component.

BRIEF DESCRIPTION OF THE DRAWINGS

Embodiments of the present technology will now be described by way of example only and with reference to the accompanying drawings, in which:—

Figure 1:
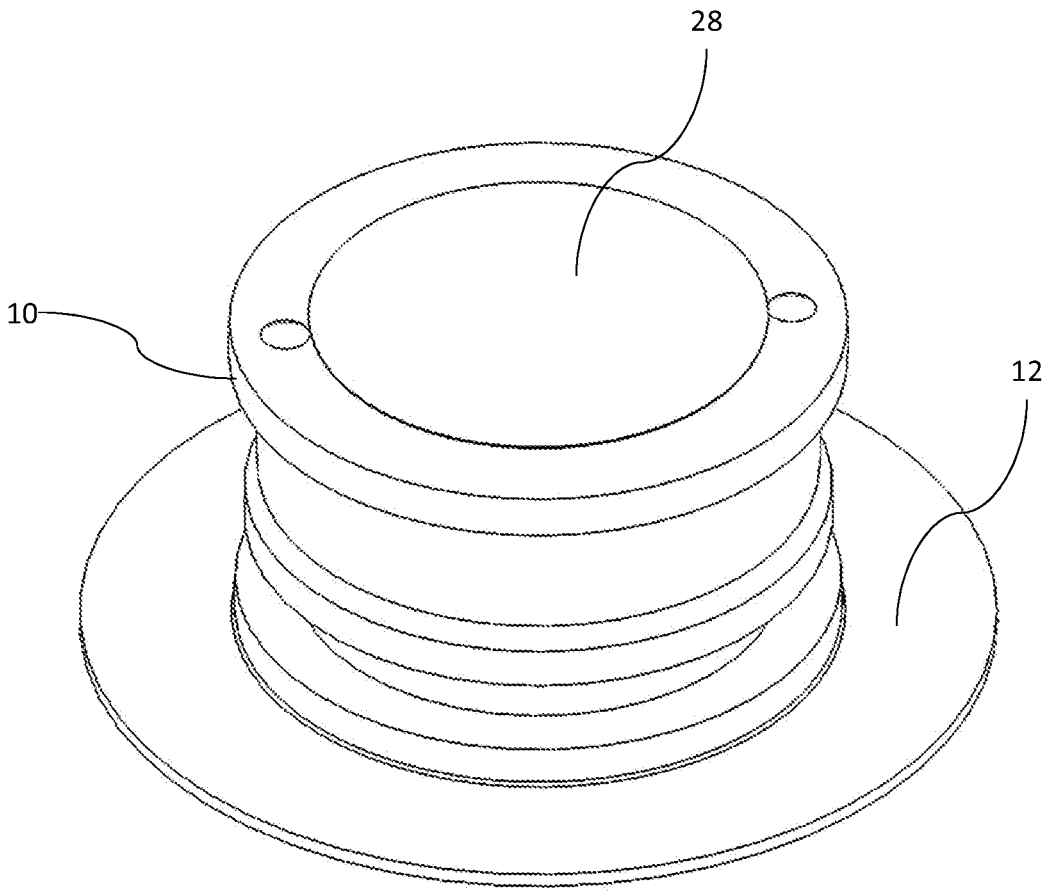
FIG. 1 illustrates an isometric view of a dispensing system according to an embodiment of the present technology.

The foregoing summary, as well as the following detailed description of embodiments of the present technology, will be better understood when read in conjunction with the appended drawings. For the purpose of illustrating the technology, certain embodiments are shown in the drawings. It should be understood, however, that the present technology is not limited to the arrangements and instrumentalities shown in the attached drawings.

DETAILED DESCRIPTION

Figure 2:
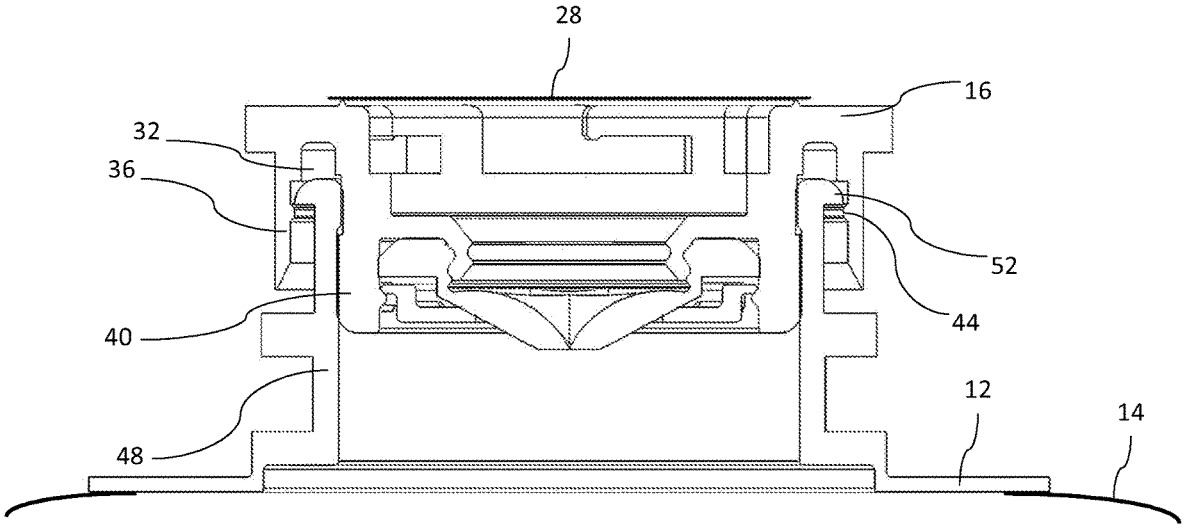
FIG. 2 illustrates a side cross-sectional view of the dispensing system of FIG. 1 attached to a bag.

The figures show a dispensing arrangement for a liquid container such as a bag in a box arrangement for holding a liquid such as milk. FIGS. 1 and 2 show a cap assembly 10 mounted to a spout 12. The spout 12 is connected to a flexible bag 14 for holding liquid. The bag 14 is made out of plastic and can be placed in a box in a conventional bag-in-box arrangement with the spout 12 and cap assembly 10 being accessible from the box. The assembly 12 may include a cover 28.

FIGS. 3 through 6 show various views of the cap assembly 10. The cap assembly 10 includes a cap 16, a valve 20, and retaining ring 24.

With reference to FIG. 2, the cap 16 can be mounted and secured to the spout 12. The cap 16 and the spout 12 can be made of plastic. The cap 16 includes a channel 32 defined by first and second collars 36 and 40 respectively. The first collar 36 includes an annular bead 44 that extends inward therefrom. The spout 12 includes a cylindrical wall 48 including a tab 52 extending radially outward along a top end thereof. The cap 16 can be positioned on the spout 12 such that the wall 48 is received in the channel 32, and the cap 16 can be locked into place with respect to the spout 12 by pushing the cap 16 downward with respect to the spout 12 with enough force such that the tab 52 snapably slides over and past the bead 44. The cap 16 can be removed from the spout 12 by pulling the cap 16 upwardly with respect to the spout 12 with enough force such that the tab 52 slides over and snaps below the bead 44.

With reference to FIGS. 3 through 6, the cap 16 includes an annular flange 56 that extends inwardly from the second collar 40. A third collar 60 extends downward from the flange 56 and that defines a bore 54 surrounding a passageway 62. The collar 60 includes beads 64 extending inwardly therefrom that define a gap 68 therebetween. The third collar 60 includes another gap 72 on the outer side thereof with an outwardly extending bead 100 below the gap 72. The second and third collars 40 and 60 define a cavity 74 therebetween. The second collar 40 includes an inwardly extending annular bead 96. The cap 16 also includes a ridge 42 on the upper surface of the cap 16.

The valve 20 is flexible and may be a duckbill valve. The valve 20 may be made of, for example, silicone, TPE, or some other flexible material. The valve 20 includes an upper outer flange 76 that includes inwardly extending top bead 80 and bottom bead 81 that define a gap 84 therebetween. The valve 20 has lips 86 that extend down from the flange 76 and that may have an opening or a partially scored area between the lips 86 that allows for a dispensing probe to be inserted through the valve 20 between the lips 86. The valve 20 is configured such that the lips 86 form a seal around the probe when it is inserted and is configured to be in a rest position when the probe is not inserted in which the opening configuration will remain closed and thereby provide a seal for the assembly 10. The retaining ring 24 has a gap 88 (FIG. 6) for receiving a portion of the valve 20 (such as the lips 86) and through which the valve 20 can extend. The retaining ring 24 further includes an upper outwardly extending flange 92.

The cap assembly 10 can be assembled by inserting the valve 20 into the bottom end of the cap 16 such that the top bead 80 of the flange 76 compresses and slides over the outwardly facing bead 100 of the third collar 60 and slides into the gap 72 of the collar 60 such that the flange 76 is secured in the cavity 74 between the second and third collars 40 and 60. The retaining ring 24 is then inserted into the bottom end of the cap 16 such that the lips 86 of the valve 20 extends through the gap 88 and the flange 92 of the ring 24 snapably slides over the inwardly extending bead 96 of the second collar 40. In this way, the ring 24 holds the valve 20 in place in the cap 16. The assembly 10 can be disassembled by pulling the retaining ring 24 out of the cap 16 (by sliding the flange 92 downward past the bead 96) and pulling the valve 20 out of the cap 16 (by pulling the flange 76 out of the cavity 74).

Figure 3:
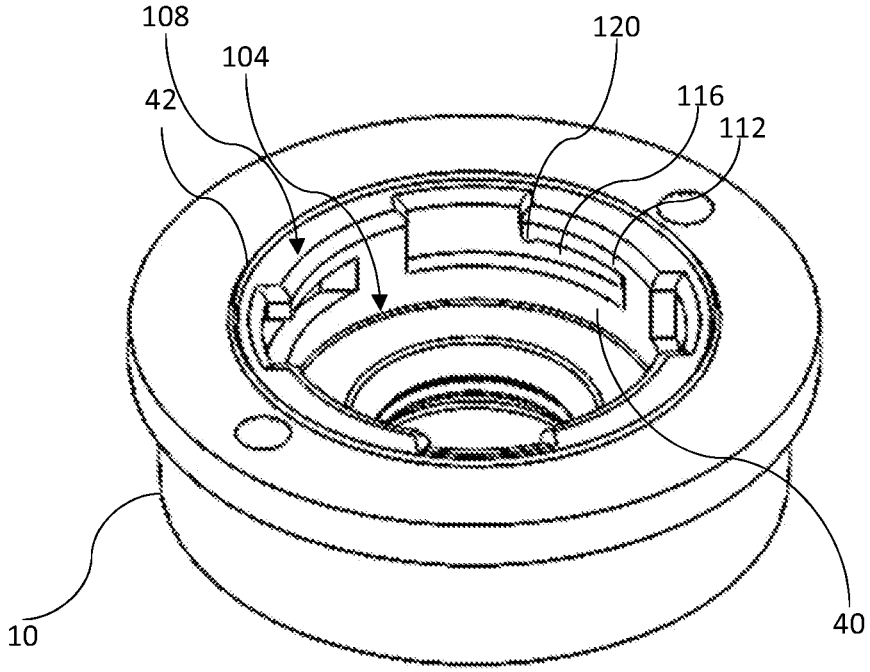
FIG. 3 illustrates an isometric view of a cap assembly according to an embodiment of the present technology.
Figure 4:
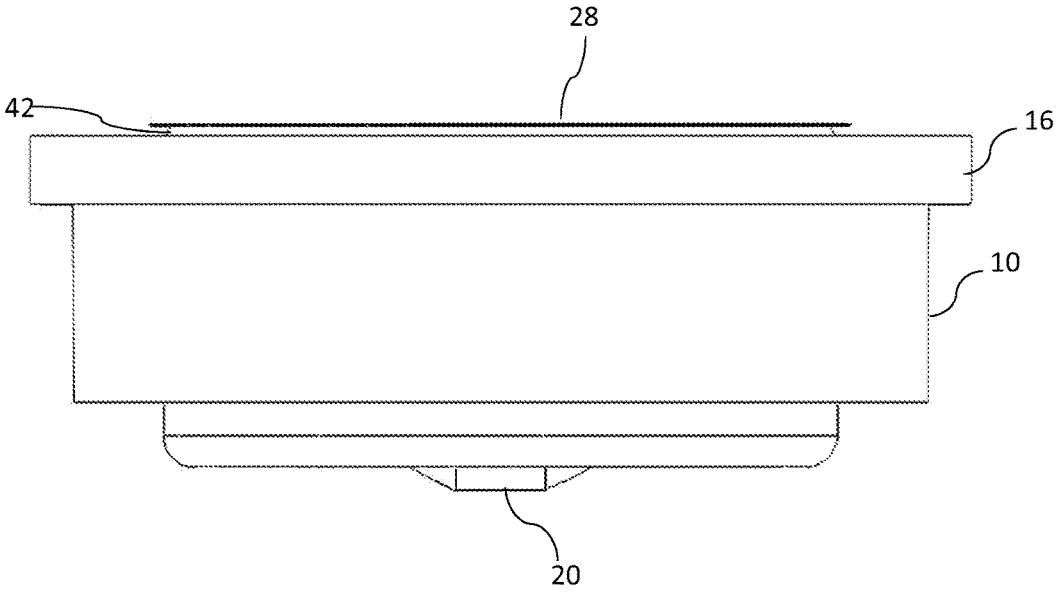
FIG. 4 illustrates a side view of the cap assembly shown in FIG. 3.
Figure 5:
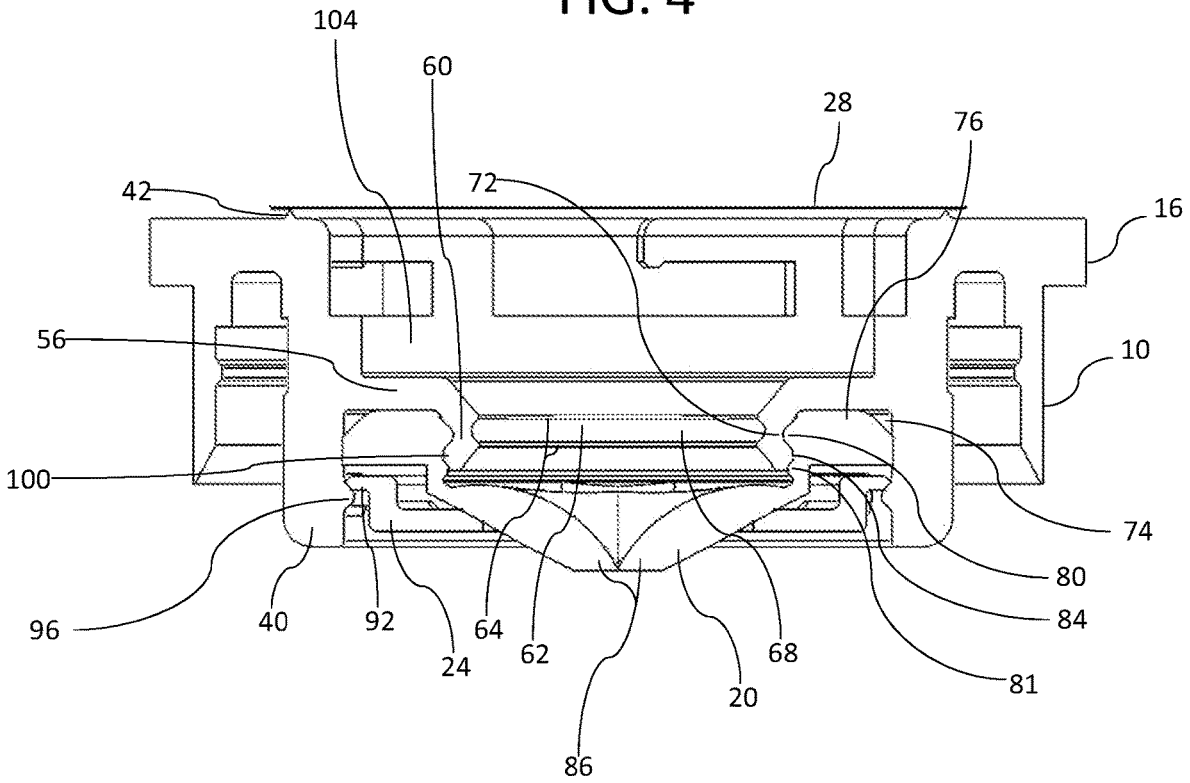
FIG. 5 illustrates a side cross-sectional view of the cap assembly shown in FIG. 3.
Figure 6:
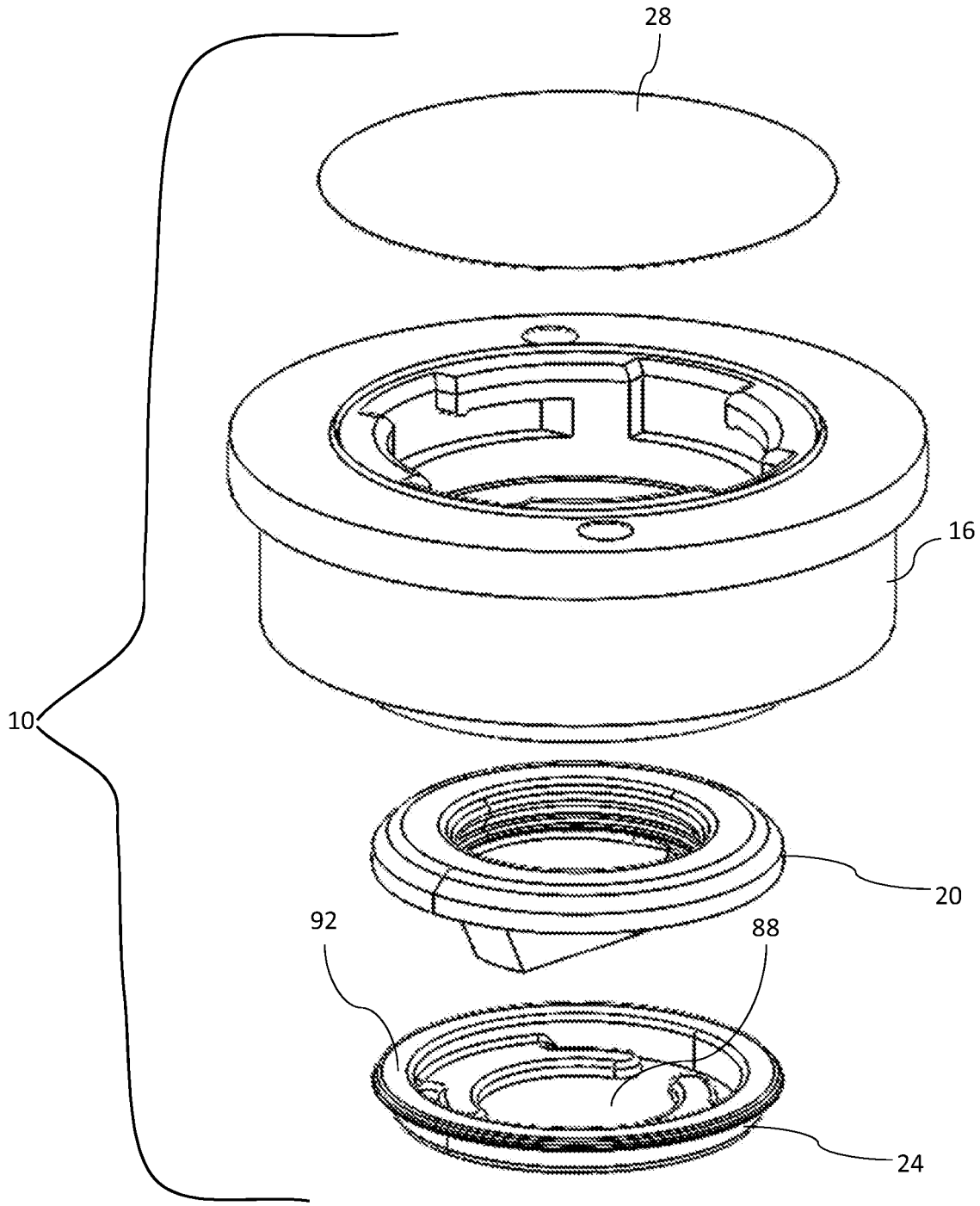
FIG. 6 illustrates an exploded isometric view of the cap assembly of FIG. 3.
Figure 7:
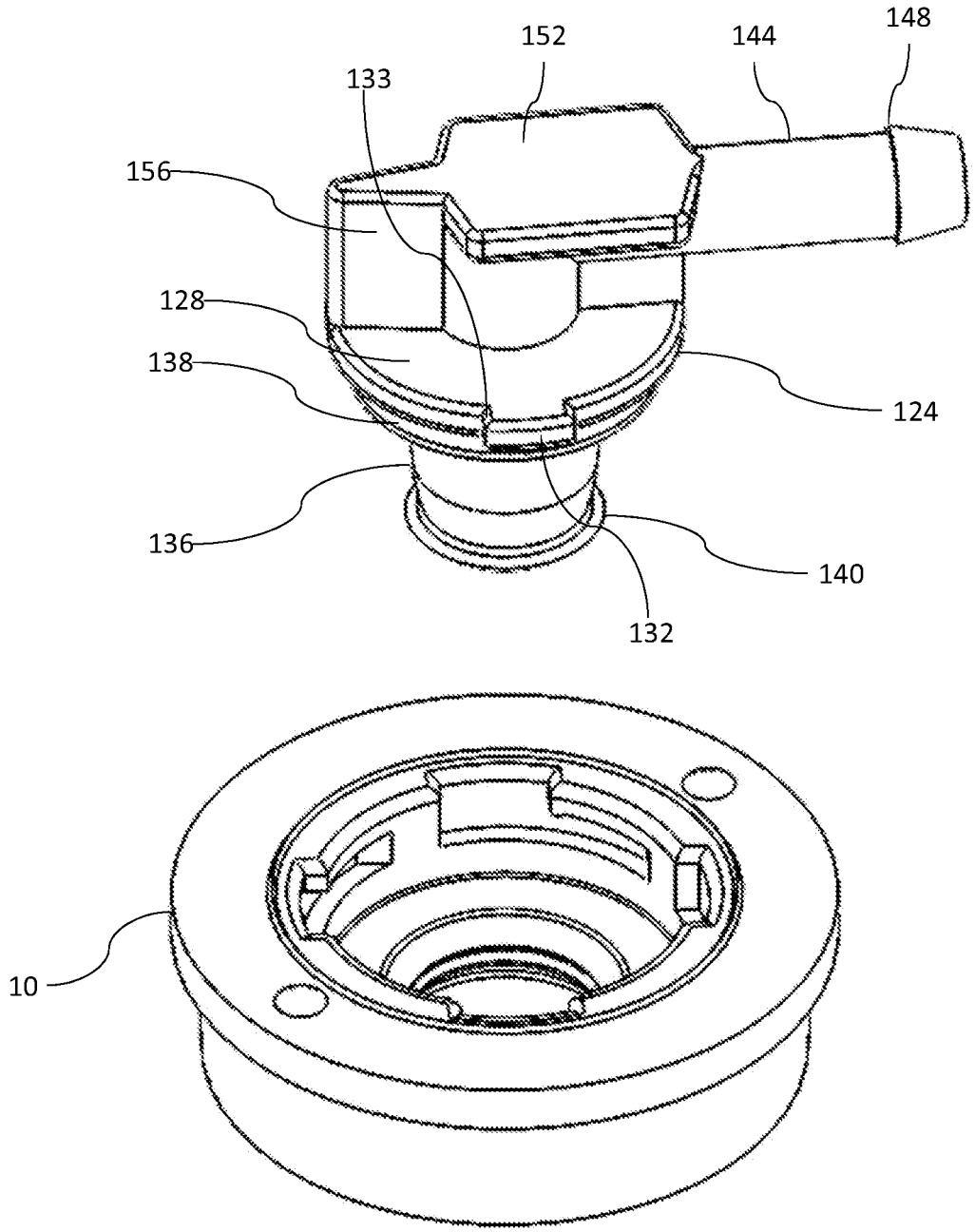
FIG. 7 illustrates an isometric view of a connecting member positioned above the cap assembly of FIG. 3 according to an embodiment of the present technology.
Figure 8:
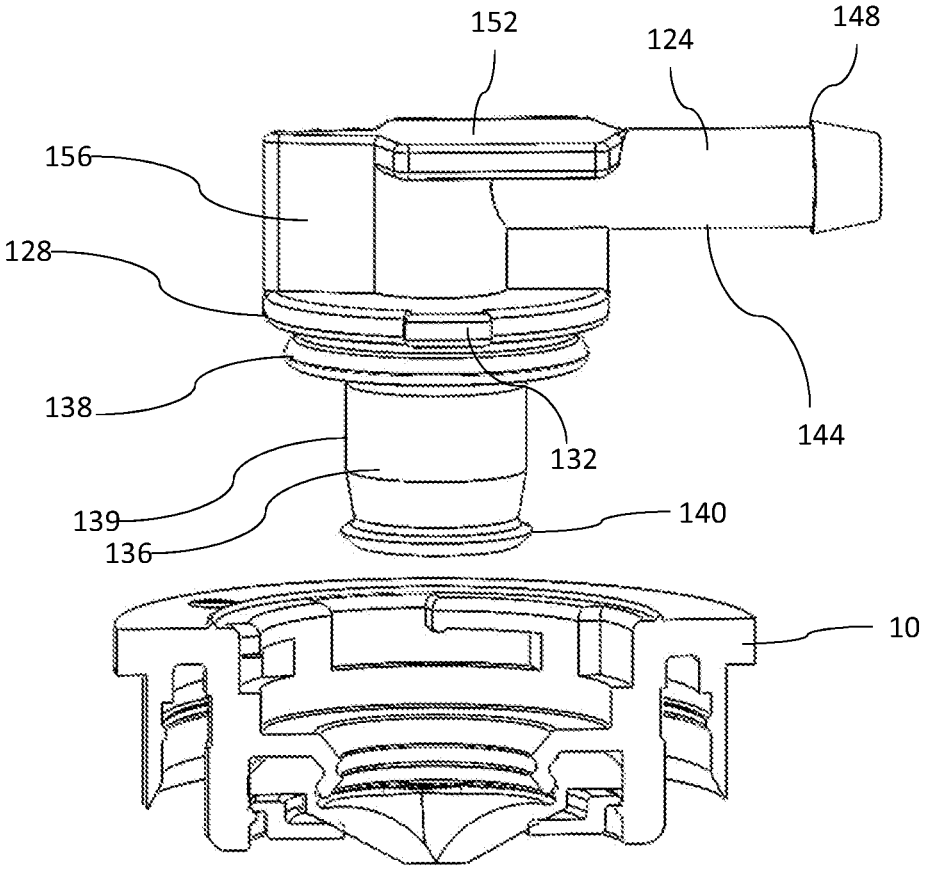
FIG. 8 illustrates a cross-sectional side view of the connecting member and cap assembly of FIG. 7.

With respect to FIG. 3, the second collar 40 of the cap 16 defines an upper cavity 104. The portion of the second collar 40 defining the cavity 104 includes four equi-spaced bayonet fittings 108. Each bayonet fitting 108 includes an L-shaped inwardly extending projection 112 defining a channel 116. The projection 112 and channel 116 may be parallel or generally parallel to the top surface of the cap 16. A downwardly extending retaining projection 120 is provided on the free end of the stem of the projection 112 to retain items in the channel 116.

When in the fully closed position after filling, the cover 28 may be added or connected to the cap assembly 10. The cover 28 could be, for example, a plug, a flip cap or dust cap, a seal, or a membrane. The cover 28 is placed on the cap 16 over and/or in the cavity 104 and can be connected to the cap 16 by adhesive, a heat seal, sonic welding, being press fitted into the cavity 104, being snapably connected to the cap 16, engaging one or more bayonet fittings 108, or any number of other ways. The cover 28 covers the cavity 104 of the cap 16 to prevent contaminants from getting into the cap assembly 10. The cover 28 may be configured to be reattached to the cap 16 after being detached from the cap 16. The cover 28 may include a tether that connects to the cap 16 such that the cover 28 is connected to the cap 16 even when removed from its position over or in the cavity 104. By way of example only, the cover 28 can be a tear off membrane that can be provided on the cap 16 over the cavity 104 after the bag 14 is filled through the spout 12. The ridge 42 provides a uniform surface for a membrane cover 28 to be either thermally or sonically welded to the cap 16 to ensure an aseptic seal is formed between the cover 28 and the cap 16. The filled bag 14 will be supplied to an end user with the membrane in place, but the membrane can be torn off when it is required to first access the contents of the bag 14.

With respect to FIGS. 7-11, a hollow connecting member 124 is also provided. The connecting member 124 includes a circular base 128 with two diametrically opposite radially extending tabs 132, which tabs 132 are of a size to fit within the channels 116 of the cap 16. A chamfer 133 extends around the upper surface of the tabs 132. Alternatively, the connecting member 124 can include more than two tabs 132 and, for example, four tabs 132. Extending below the base 128, is a hollow projecting member 136 that may include a distal rim 140. The rim 140 may be made of a softer material than the surrounding portions of the projecting member 136. The projecting member 136 is of a size to fit into and through the cap 16. The connecting member 124 includes an annular seal or bead 138 positioned beneath the base 128 and above the projecting member 136. The hollow projecting member 136 has a tapered end and may come to a point to help rupture the partially scored area of the valve lips 86. The projecting member 136 also has a smooth upper surface 139.

On the opposite side of the base 128, a radially extending tube 144 is provided with one or more barbs 148. The tube 144 may be perpendicular, or generally perpendicular, to member 136. A smaller plate 152 is provided above the tube 144 with a rotation tab 156 extending in a diametrically opposite direction to the tube 144, with the plate 152 and rotation tab 156 facilitating manual movement and rotation of the connecting member 124.

Figure 9:
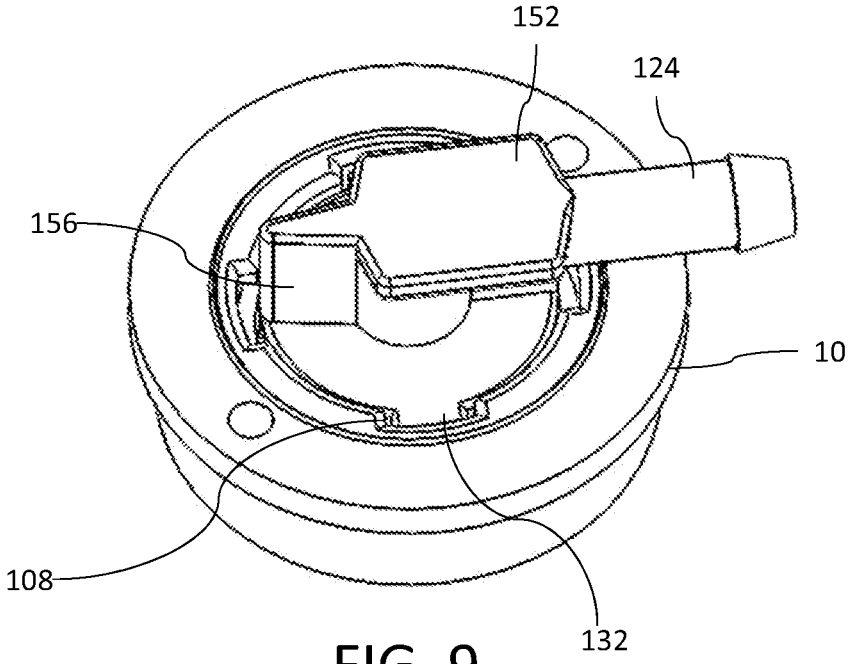
FIG. 9 illustrates a top isometric view of the connecting member inserted in the cap assembly according to an embodiment of the present technology.
Figure 10:
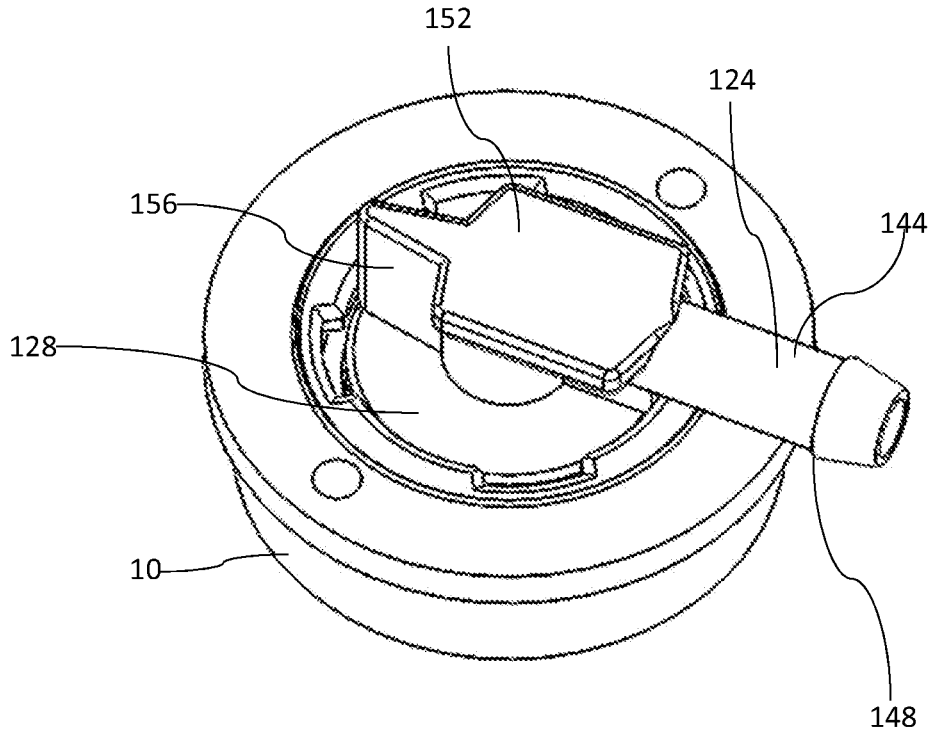
FIG. 10 illustrates a top isometric view of the connecting member inserted in and rotated within the cap assembly according to an embodiment of the present technology.

In operation, the bag 14 is filled through the spout 12 with liquid, such as milk. After the bag 14 is filled, the cap assembly 10 is mounted and secured to the spout 12 as described above. The valve 20 is in contact with the liquid and prevents liquid from exiting the bag 14. When it is required to access the contents of the bag 14, the cover 28 can be removed from the cap 16 (such as by being peeled off the cap). As shown in FIG. 9, the connecting member 124 can then be inserted into the cap 16, with the tabs 132 going into the cavity 104 and engaging with either pair of bayonet fittings 108. As shown in FIG. 10, the connecting member 124 can be pushed downwardly and rotated until the tabs 132 locate in their respective channels 116. The tab chamfers 133 aid in allowing the tabs 132 to rotate past the retaining projections 120 after the connecting member 124 is inserted into the cap 16. The retaining projections 120 and/or inwardly extending projections 112 may elastically deflect while the tabs 132 rotate past the retaining projections 120. The tabs 132 are locked in the channels 116 and are located completely below a top surface of the cap 16. The valve 20 resistibly or reactively urges the connecting member 124 outwardly such that the tabs 132 will be held in the channels 116 by the retaining projections 120 to prevent any inadvertent disconnection.

Figure 11:
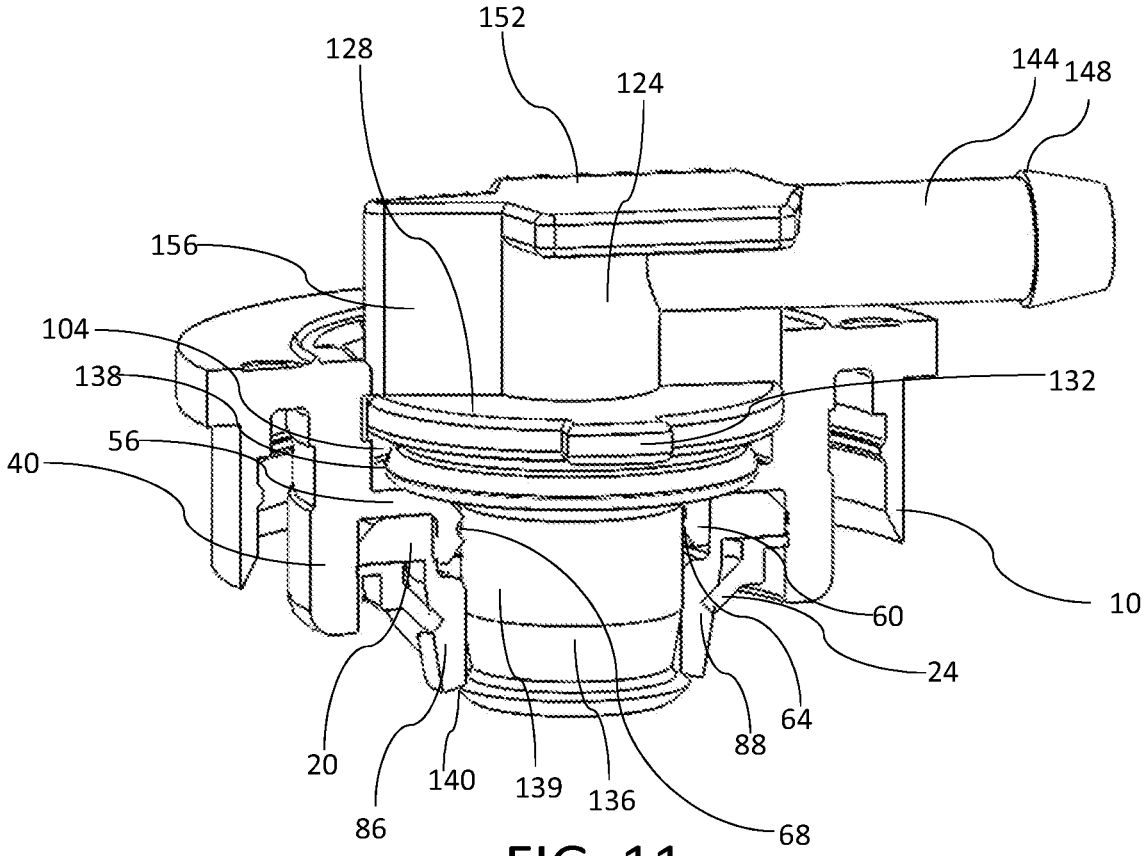
FIG. 11 illustrates a cross-sectional side view of the connecting member inserted in the cap assembly according to an embodiment of the present technology.

With reference to FIG. 11, as the projecting member 136 is inserted in to the cap assembly 10, the projecting member 136 extends into the bore and through the passageway 62 and opens the valve 20 by extending between the lips 86 of the valve 20 and the gap 88 in retaining ring 24 such that liquid will flow from the bag 14 through the connecting member 124 into the tube 144. The lips 86 form a seal around the projecting member 136. The bead 138 of the connecting member 124 engages the flange 56 extending inwardly from the second collar 40 to establish the fully inserted position of the connecting member 124 within the cap 16. The beads 64 extending inwardly from the third collar 60 sealingly engages the upper surface 139 of the projecting member 136 to prevent liquid from flowing into the upper cavity 104. The projecting member 136 may have a rib or bead that can rest in the gap 68 of the third collar 60.

An appropriate tube, pipe, or line is connected to the tube 144 and connects to the machine for which the liquid in the bag 12 is used, such as a coffee machine or smoothie machine. The barb 148 helps retain the tube, pipe, or line to the tube 144. Thus, when the connecting member 124 is connected to the cap assembly 10, liquid is free to flow from the bag 12 through the connecting member 124 and the line to the machine. The connecting member 124 may be referred to as a line side connector since it connects the bag to a machine. In other embodiments, the barb 148 may be omitted and a push-to-connect or similar type fitting may be used to connect the associated machine tubing.

When it is required to disconnect the connecting member 124 from the cap assembly 10, the connecting member 124 is pushed against the reactive force from the resilient valve 20, and the tabs 132 contact the retaining projections 120, deflecting the extending projections 112 and/or retaining projections 120 to allow the tabs 132 to move past the retaining projections 120 and out of the channels 116. The connecting member 124 can then be moved away from the cap assembly 10. As the projecting member 136 moves away from the valve 20, the lips 86 reseal to close the valve 20. The connecting member 124 and any connected tubing, line, or pipework can then be cleaned prior to subsequent reuse.

With respect to FIGS. 12-16, an alternative connecting member 224 is provided that may be connected to the cap 16 of FIGS. 1-11 as well as the associated tubing of a dispensing machine as described above. The connecting member 224 includes a circular base 228, and includes four equally spaced radially extending tabs 232. The tabs 232 have a tapered surface 234 that leads to a flat surface 235. The flat surface 235 may be level with the top surface of the circular base 228. Alternatively, the connecting member 224 could have fewer or more tabs and/or the tabs could have symmetric chamfered corners similar to the tabs 132 of the connecting member 124 of FIGS. 7-11. The connecting member 224 also includes an inlet member 236 that extends below the base 228 and that defines an inlet, an outlet member 244 that defines an outlet, and a rotation tab 256.

The inlet member 236 includes main body portion 260, a flexible valve 270, and a valve retention piece 280. The main body portion 260 includes a retention ledge 262, a retention groove 264, and a bottom surface 266. The valve retention piece 280 also includes a retention ledge 282, a retention groove 284, and a compression surface 286. The flexible valve 270 includes a retention flange 272, a cylindrical portion 274, a tapered portion 276, and an opening 278.

In the assembled condition, the main body retention ledge 262 is inserted into the valve retention piece retention groove 284 while the valve retention piece retention ledge 282 is inserted into the main body retention groove 264 forming a snap fit connection 290 between the main body portion 260 and the valve retention piece 280. The outer diameter of the main body 260 and the outer diameter of the retention piece 280 are the same or generally the same at the connection point 290 to create a smooth transition between the retention piece 280 and the main body portion 260. Above the connection point 290, the outer surface of the main body portion 260 has a smooth surface and may have a slight taper to help create a seal against both the valve lips 86 and the beads 64 of the third collar 60 of the cap 16. The valve retention piece 280 has a tapered end 289 to help rupture the cap valve lips 86.

The flexible valve 270 may be made of, for example, silicone, TPE, or some other flexible material. The valve retention flange 272 is held between the main body bottom surface 266 and the retention piece compression surface 286, preventing movement of the lower portion of the flexible valve 270. The outer surface of the valve cylindrical portion 274 fits within the inner surface of the main body portion 260. The valve tapered portion 276 extends above the cylindrical portion 274 further into the connector main body portion 260 and ends with the opening 278.

Figure 12:
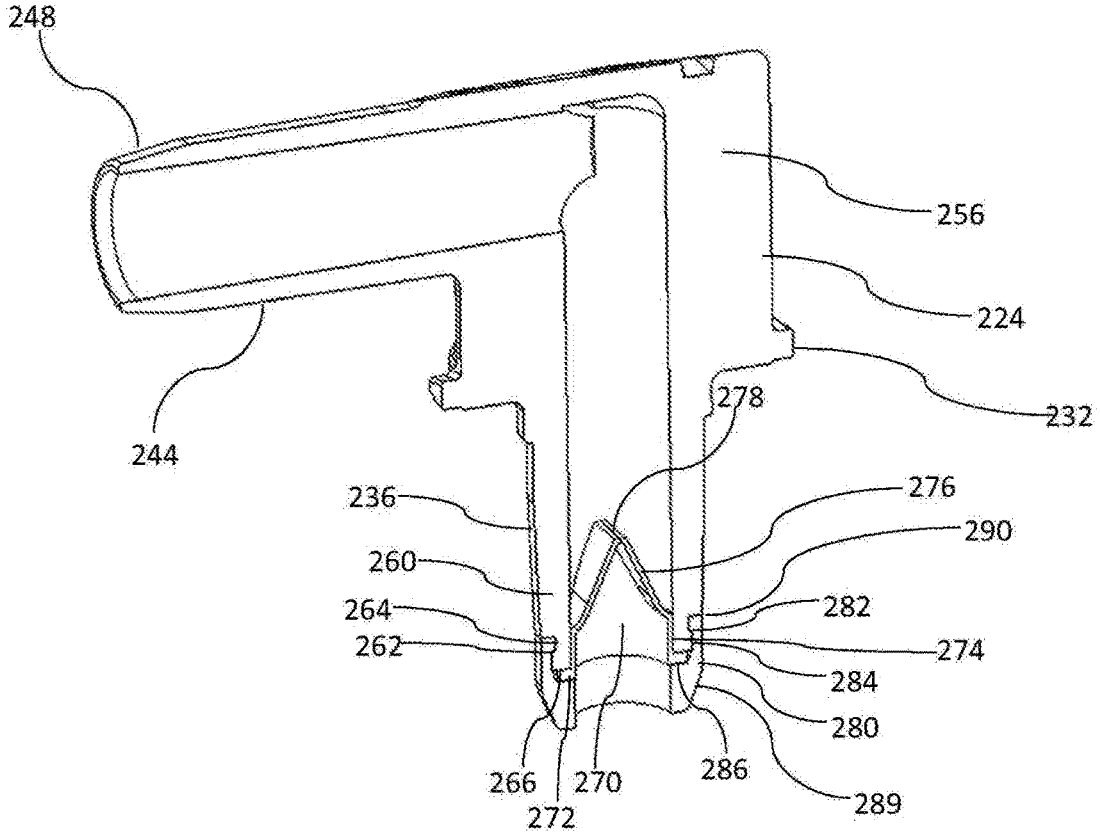
FIG. 12 illustrates a cross-sectional side view of alternative embodiment of a connecting member with a valve that may be used with the cap assembly of FIG. 3.
Figure 13:
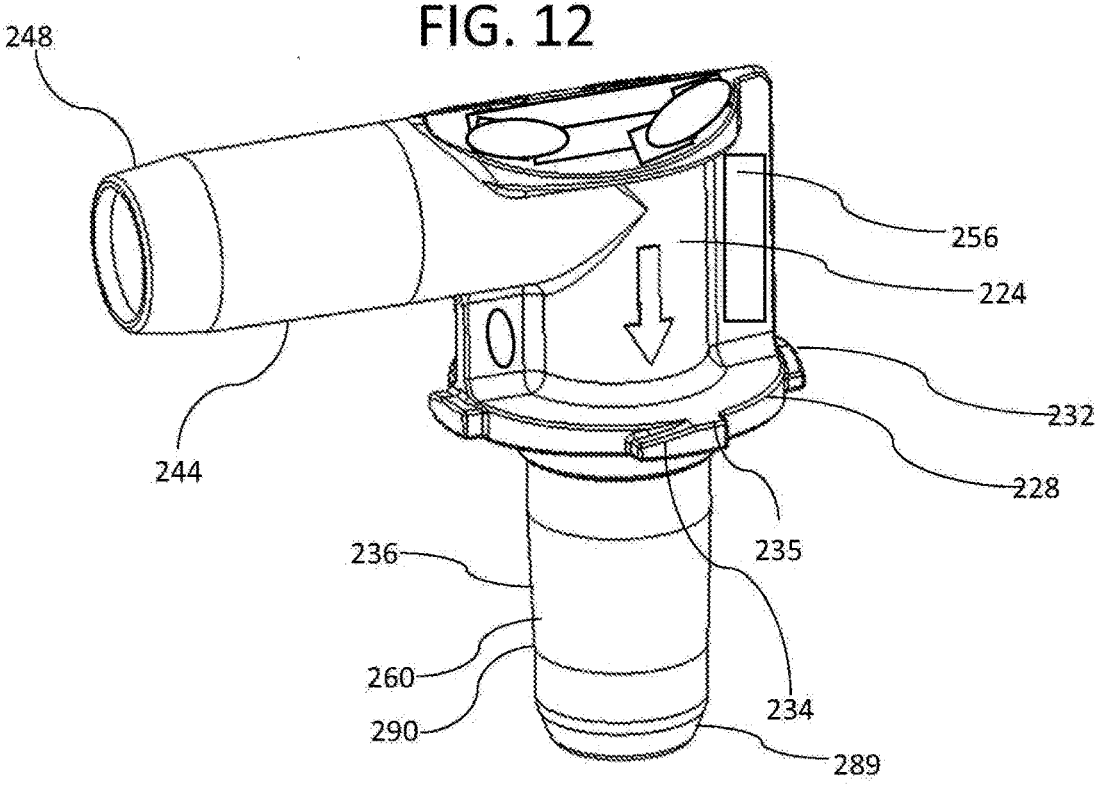
FIG. 13 illustrates an isometric view of the connecting member of FIG. 12.
Figure 14:
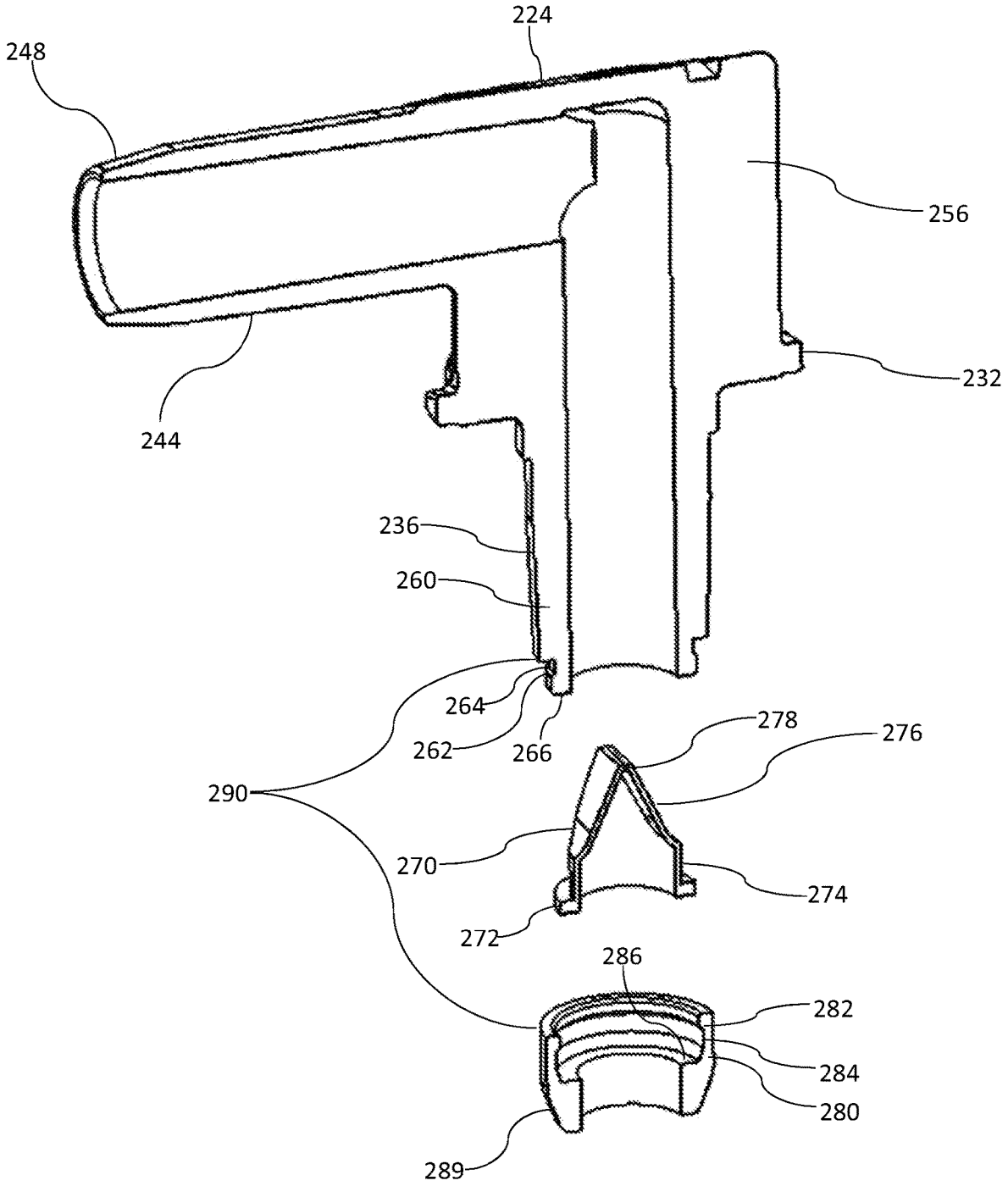
FIG. 14 illustrates an exploded cross sectional view of the connecting member of FIG. 12.
Figure 15:
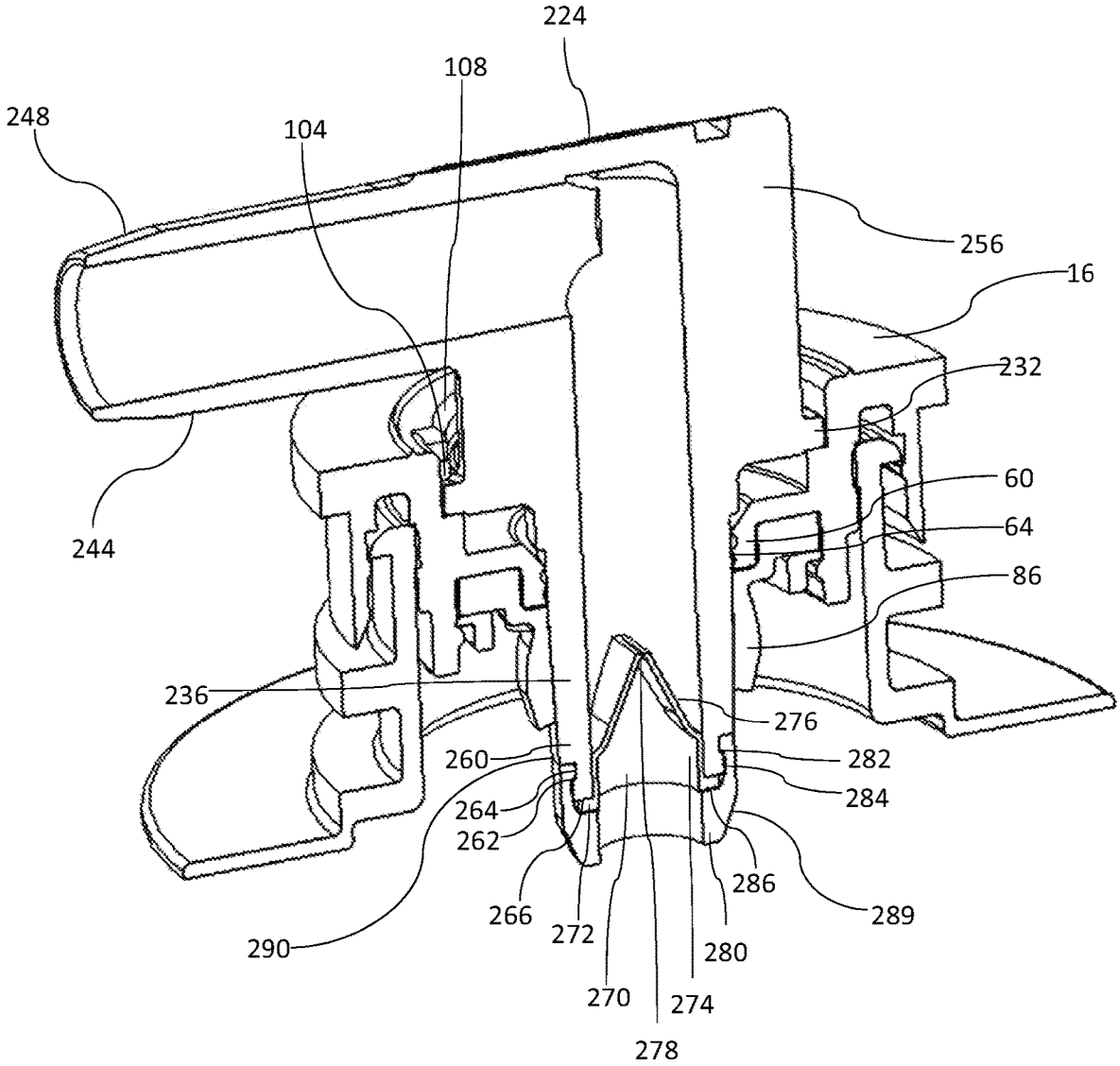
FIG. 15 illustrates an isometric view of a connecting member of FIG. 12 inserted within the cap assembly of FIG. 3 with the connecting member valve in a closed position.

The flexible valve 270 is molded to act as a check valve such that the opening 278 prevents fluid from flowing from the connector body outlet member 244 past the valve 270 towards the connector body inlet member 236 as shown in FIGS. 12-15. This keeps the fluid above the flexible valve 270, including the fluid in the connected tubing and from the dispensing machine, from leaking from the inlet member 236 when the connecting member 224 is not attached to a container as seen in FIGS. 12-13. The arrangement also prevents fluid from flowing backward from the tubing and machine and into a connected container as shown in FIG. 15. The proximity of the flexible valve 270 to the bottom of the inlet member 236 further reduces the volume of liquid that may be released from the connecting member 224 after disconnecting the connecting member 224 from the cap 16 of a container, thus reducing any spillage that may occur and the associated required cleaning from such spillage. Additionally, by reducing the amount of liquid lost from the tubing while the connecting member 224 is not attached to a container, the connecting member 224 also reduces the amount of air introduced into the tubing and system. This improves the system performance and reduces the need to vent air from the associated pumps, tubing, and any other portions of the connected system.

On the opposite side of the base 228, the connector outlet 244 extends radially. In the present embodiment, the connector outlet 244 includes a tapered end 248 to aid in connecting the tube, pipe or line of the connected machine. In other embodiments, a barb similar to the barb 148 of the connecting member 124 of FIGS. 7-11 could also be used.

A tab 256 extends in a diametrically opposite direction to the connector outlet 244 to facilitate manual movement and rotation of the connecting member 224.

Figure 16:
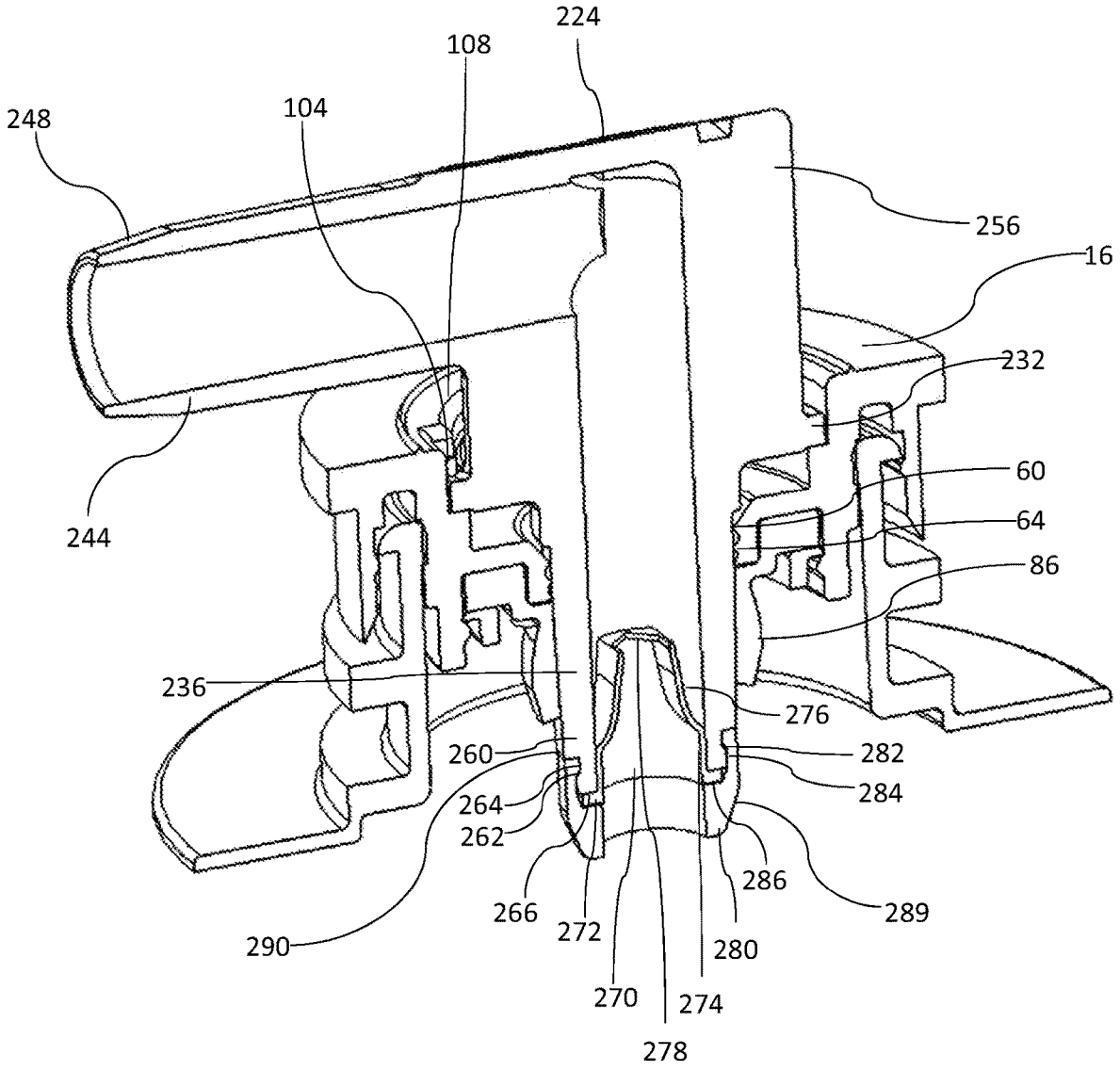
FIG. 16 illustrates an isometric view of a connecting member of FIG. 12 inserted within the cap assembly of FIG. 3 with the connecting member valve in an open position.

Similar to the connecting member 124 of FIGS. 7-11, the connecting member 224 of the second embodiment can be inserted into the cap 16 by inserting the inlet member 236 into the cap 16 while aligning the tabs 232 with the cap cavity 104. The connecting member 224 is then rotated to allow the tabs 232 to engage the bayonet fittings 108 and allow the retaining projections 120 to engage the tabs 232 and secure the connecting member 224 within the cap 16, as shown in FIGS. 15 and 16. As a result, the connecting member flexible valve 270 may extend below the cap valve 20, the cap third collar 60, and/or the upper surface of the cap 10 when the connecting member 224 is fully installed within the cap 10.

In operation, the system may use a vacuum pump to draw suction from the container. The resulting lower pressure on the upper surface of the flexible valve 270 results in the deformation of the valve tapered portion 276 and causes valve opening 278 to spread thus allowing fluid to flow from the inlet member 236 past the valve 270 to the outlet member 244 as shown in FIG. 16. The inner surface of the valve cylindrical portion 274 has the same or generally the same inner diameter as the inner surface of the retention piece 280 to improve the fluid flow characteristics through the connecting member 224 during the dispensing of the container's contents.

In some embodiments, the snap fit connection 290 of the inlet member 236 may be reversible to allow for the removal of the valve 270 for cleaning purposes. In other embodiments, the main body and retention piece could use corresponding threaded surfaces to removably connect the main body and retention piece. In yet other embodiments, the dimensions of the main body and retention piece retention ledges 262 and 282 respectively may be adjusted to prevent the separation of the snap fit connection 290 and, thereby, prevent the removal of the valve retention piece 280 and flexible valve 270 after assembly. Alternatively, the main body and retention piece could be permanently attached with a sonic weld, a thermal weld, or an adhesive either with or without the use of a snap fit connection.

Figure 17:
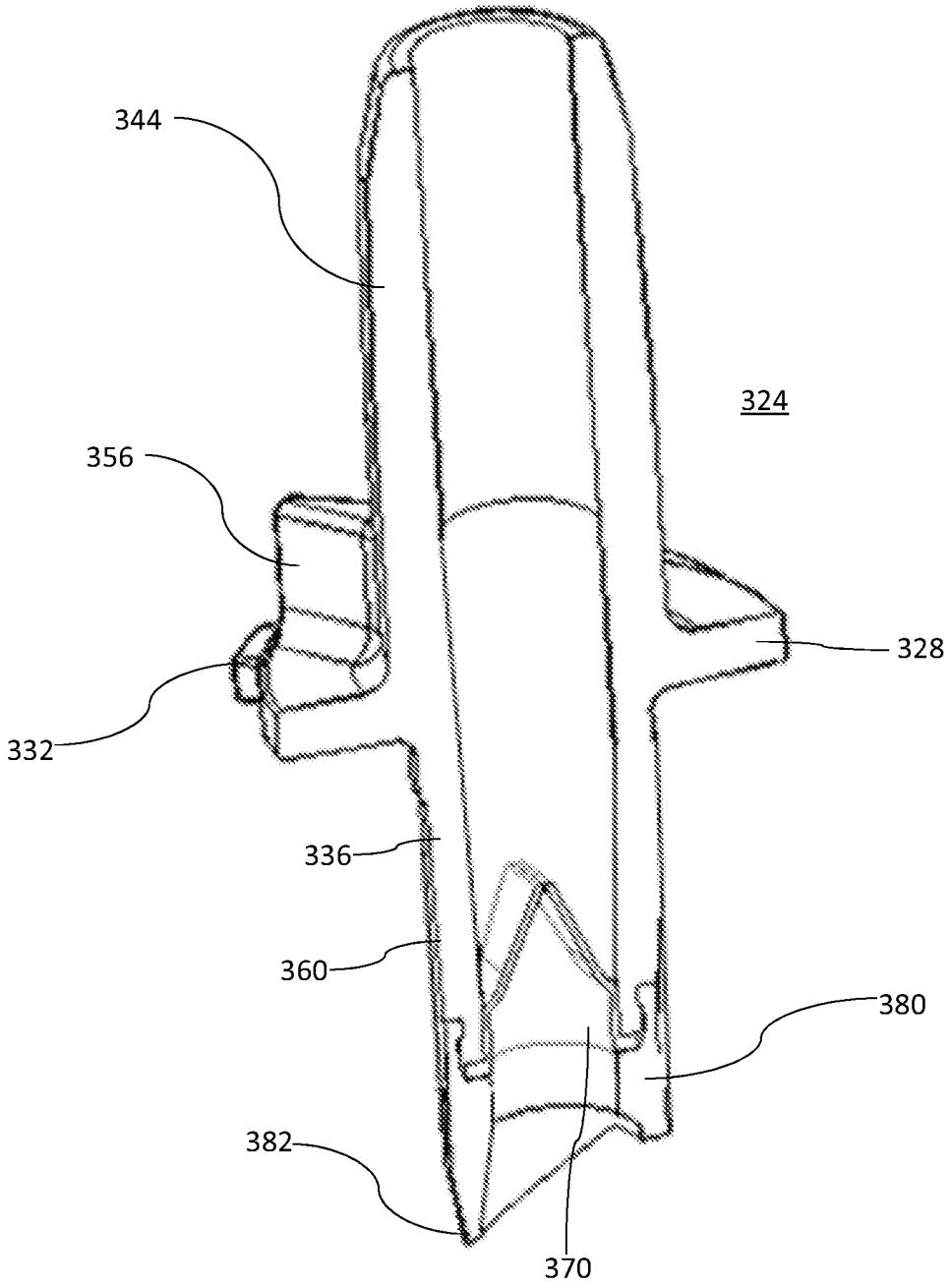
FIG. 17 illustrates a cross-sectional side view of third embodiment of a connecting member with a valve that may be used with an alternative cap assembly.

FIG. 17 shows a third embodiment of a connecting member 324 that may be connected to cap similar to the cap 16 of FIGS. 1-11 but that has a pierceable membrane located, for example, over the valve. The connecting member 324 also includes an inlet member 336 that extends below a circular base 328 that is in line with an outlet member 344. The inlet member 336 also includes a main body portion 360, a flexible valve 370, and a valve retention piece 380. The valve retention piece 380 has a pointed tip 382 in order to pierce the inner membrane of a single use style cap and/or the valve. Two equally spaced radially extending tabs 332 and a rotation tab 356 extend from the base 328. Other connector embodiments may combine different aspects of the second connector 224 and the third connector 324 without departing from the scope of the technology.

Figure 18:
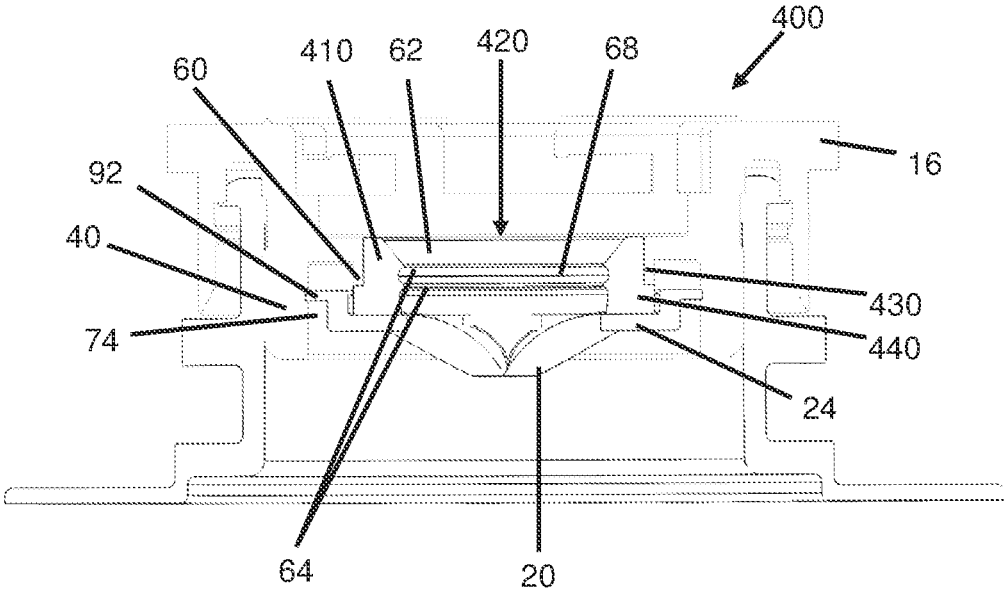
FIG. 18 shows a cross-sectional side view of a cap assembly according to another embodiment of the present technology.

FIG. 18 shows a cross-sectional side view of a cap assembly 400 according to another embodiment of the present technology. The cap assembly 400 is similar to the cap assembly 10 of FIG. 2 but differs in the ways described herein. The cap assembly 400 includes a bore 410 that is formed as a single component 420 with the valve 20 and that is not formed as part of the third collar 60 of the cap 16. The bore 410 defines the passageway 62 and includes the beads 64 and the gap 68 therebetween, which interact with a connecting member in the same manner as the beads 64 and gap 68 of the cap assembly 10. The bore 410 fits within an inner wall 430 of the third collar 60 and includes a lower flange 440 that is secured between a bottom edge of the third collar 60 and the retaining ring 24. The single component 420 is made of a flexible material which can be, by way of example, an elastomer.

The retaining ring 24 can be secured within the gap 74 of the cap 16 between the second and third collars 40 and 60 or between the second collar 40 and the flange 440 of the single component 420 to secure the single component 420 between the retaining ring 24 and the third collar 60. By way of example, the retaining ring 24 may be snapably inserted and secured in the gap 74 by the interaction of a bead and a groove or may be press fitted in the gap 74. By further example, the outer flange 92 of the retaining ring 24 may snapably slide over one or more beads extending internally from the second collar 40. The cap 16 and the retaining ring 24 may be made of the same material and, in particular, may be made of a more rigid plastic material than the single component 420, such as a thermoplastic. The bore 410 is made of the same flexible material as the valve 20 and, thus, forms a flexible seal with the connecting member when the connecting member is inserted into the bore 410 and engages the beads 64 and/or gap 68 of the bore 410. In an alternative embodiment, the valve 20 and bore 410 can be separate pieces made of the same or similar flexible material and can be secured between the retaining ring 24 and the third collar 60 together.

The cap assembly 400 can be formed by a twin shot molding process by which two different plastic resins are molded together in a single machining cycle. In a first phase of such a process, a shot of resin is injected into a mold and cooled to form a first solid part, and, in a second phase, the molded part may be transferred to a second mold and receive second shot of resin in, through, and/or around all or parts of the first molded part. The two plastic resins form a molecular bond, and the multi-resin molded part is cooled and ejected. With respect to cap assembly 400, the cap 16 can be formed in a mold with a shot of a first resin, which, by way of example, may be a thermoplastic that forms a rigid or hard plastic suitable for packaging. The single component 420 then can be formed in the cap 16 as shown in FIG. 18 with a shot of a second resin, which, by way of example, may be an elastomer that is flexible when cured. By forming the cap assembly 400 in this way, and with chemically compatible materials such as elastomer and thermoplastic, a chemical bond and a hermetic seal can be formed between the cap 16 (which may be made of a thermoplastic material) and the single component 420 (which may be made of an elastomeric material) where they connect. The retaining ring 24 can be made separately and then connected to the cap 16 to secure the single component 420 in the cap 16 after the single component 420 is formed in the cap 16. The retaining ring 24 can be made of the same material as the cap 16.

The above described arrangement(s) can be used in a bag in box container for milk or other liquids. The connecting member can readily be disconnected from the cap assembly to permit regular cleaning while the valve automatically closes. Use of a container such as a bag in box container allows for using the milk in aseptic conditions. The provision of bayonet fittings allows for the connecting member to be easily and readily fitted irrespective of the alignment of the cap on the container.

The twin shot method of forming the cap assembly simplifies the assembly process of the cap assembly by making the entire component in the molding process (so as to avoid separately assembling the valve and/or bore with the cap) and provides a chemical bond and hermetic seal between the separately formed components.

Various other modifications may be made without departing from the scope of the present technology. For instance different mounting arrangements may be provided other than bayonet fittings, and more than two sets may perhaps be provided. Rather than a snap fit the ring member could threadingly engage with the ring part. The connecting member may take a different form. The arrangement could be used other than with bag in box containers for liquid such as milk.

While endeavoring in the foregoing specification to draw attention to those features of the present technology believed to be of particular importance it should be understood that the Applicant claims protection in respect of any patentable feature or combination of features hereinbefore referred to and/or shown in the drawings whether or not particular emphasis has been placed thereon. In addition, while particular elements, embodiments and applications of the present technology have been shown and described, it will be understood that the technology is not limited thereto since modifications can be made by those skilled in the art without departing from the scope of the present disclosure, particularly in light of the foregoing teachings.

The invention claimed is:

1. A system, comprising:

a dispensing system, comprising:

a cap configured to be mounted to a spout connected to a container, the cap including a bore and a plurality of channels, wherein each of the plurality of channels is defined by a projection and a retaining projection on a free end of a stem of the projection, a first valve positioned in the cap to be in contact with liquid contents of the container, wherein the first valve is made of a first flexible material, and a retaining ring connected to the cap beneath the valve to secure the first valve to the cap; and a connecting member, comprising:

an inlet member defining an inlet, wherein the inlet member comprises a plurality of tabs configured to connect to the cap, and an outlet member defining an outlet, wherein the outlet member is configured to connect to a system supply line, and a plurality of tabs, each of which includes a chamfer extending around an upper surface;

wherein each of the plurality of channels of the cap is configured to receive one of the plurality of tabs of the connecting member; and wherein the connecting member is securable to the cap by inserting the connecting member into the bore of the cap and then rotating the connecting member with respect to the cap such that each of the plurality of tabs is secured in one of the plurality of channels under the projection of the one of the of the plurality of channels, wherein the chamfer of each of the plurality of tabs aids in allowing the each of the plurality of tabs to rotate past the retaining projection of the one of the plurality of channels.

2. The system of claim 1, wherein, when the connecting member is secured to the cap, the projecting member sealingly engages the bore and urges an opening in the first valve to permit liquid in the container to pass into the inlet of the connecting member and subsequently out through the outlet.

3. The system of claim 2, wherein the connecting member includes a seal, and the cap includes an inwardly extending flange, wherein, when the connecting member is secured to the cap, the seal engages the flange to create a seal therebetween.

4. The system of claim 1, wherein one of the bore and the connecting member includes a bead that is configured to form a seal between the bore and the connecting member when the connecting member is secured to the cap.

5. The system of claim 1, wherein the at least one channel is located below a top surface of the cap.

6. The system of claim 1, wherein the bore and the first valve are integral and made of the first flexible material and are secured between the retaining ring and an inner collar of the cap.

7. The system of claim 1 further comprising a cover that covers at least a portion of the cap.

8. The system of claim 1, wherein the first valve is secured below an inwardly extending flange of the cap.

9. The system of claim 1, wherein the bore is defined by an inner collar of the cap.

10. The system of claim 1, wherein the retaining ring is snapably connected to the cap to secure the valve to the cap.

11. The system of claim 1, wherein the connecting member further includes:

a second valve positioned between the inlet and outlet such that:

the second valve allows fluid to flow from the inlet to the outlet; and the second valve prevents fluid from flowing from the outlet to the inlet;

wherein the second valve is made of a flexible material.

12. The system of claim 11, wherein the second valve is located within the inlet member of the connecting member.

13. The system of claim 12, wherein the connecting member further comprises:

an outwardly extending connector flange that includes at least one tab;

wherein the second valve is located below the connector flange.

14. The system of claim 11, wherein the inlet member includes a main body and a valve retention piece, wherein the second valve further comprises a valve flange and the valve flange is compressed between the main body and the valve retention piece.

15. The system of claim 14, wherein:

the valve retention piece has an outer diameter at an adjacent surface to the main body;

the main body has an outer diameter at an adjacent surface to the valve retention piece; and the valve retention piece outer diameter and the main body outer diameter are generally the same.

16. The system of claim 15, wherein:

the valve retention piece has an inner diameter at an adjacent surface to the second valve;

the second valve has an inner diameter at an adjacent surface to the valve retention piece; and the valve retention piece inner diameter and the second valve inner diameter are generally the same.

17. The system of claim 1, wherein, after the connecting member is secured to the cap, the first valve resistibly or reactively urges the connecting member outwardly such that each of the plurality of tabs will be held in one of the plurality of channels by the retaining projections.

18. The system of claim 1, wherein the plurality of tabs are equally spaced around the connecting member.

* * * * *